US007338345B2

(12) United States Patent
Fujinami

(10) Patent No.: US 7,338,345 B2
(45) Date of Patent: Mar. 4, 2008

(54) CUTTING MACHINE

(75) Inventor: Koichi Fujinami, Tokyo (JP)

(73) Assignee: Disco Corporation, Tokyo (JP)

( * ) Notice: Subject to any disclaimer, the term of this patent is extended or adjusted under 35 U.S.C. 154(b) by 56 days.

(21) Appl. No.: 11/287,190

(22) Filed: Nov. 28, 2005

(65) Prior Publication Data

US 2006/0112802 A1 Jun. 1, 2006

(30) Foreign Application Priority Data

Nov. 30, 2004 (JP) ..... 2004-346981

(51) Int. Cl.
*B24B 19/00* (2006.01)
*B24B 49/12* (2006.01)

(52) U.S. Cl. ..... 451/5; 125/13.01; 125/23.01; 451/6

(58) Field of Classification Search ..... 451/178, 451/5, 8, 9, 10, 6; 125/13.01, 23.01
See application file for complete search history.

(56) References Cited

U.S. PATENT DOCUMENTS 6,345,616 B1 * 2/2002 Umahashi ..... 125/13.01
6,422,227 B1 * 7/2002 Kobayashi et al. ..... 125/13.01
6,606,985 B2 * 8/2003 Negishi ..... 125/13.01
6,726,526 B2 * 4/2004 Sekiya et al. ..... 451/5
2003/0056628 A1 * 3/2003 Razon ..... 83/34

FOREIGN PATENT DOCUMENTS

JP 2003-163178 6/2003

* cited by examiner

*Primary Examiner*—Robert A. Rose
(74) *Attorney, Agent, or Firm*—Smith, Gambrell & Russell, LLP

(57) ABSTRACT

A cutting machine comprising a chuck table for holding a workpiece, which is arranged such that it can move along a guide rail extending in a predetermined direction, a gate-like support frame that is arranged straddling the guide rail and has an opening for allowing the movement of the chuck table, an alignment means arranged on one flank of the gate-like support frame, and a cutting means arranged on the other flank of the gate-like support frame, wherein the cutting means is composed of an indexing-feed base arranged on the other flank of the gate-like support frame such that it can move in a direction perpendicular to the guide rail, a cutting-in feed base arranged on the indexing-feed base such that it can move in a direction perpendicular to the holding surface of the chuck table, and a spindle unit that is mounted on the cutting-in feed base and has a cutting blade, the spindle unit being arranged on the alignment means side through the opening of the gate-like support frame.

7 Claims, 3 Drawing Sheets

CUTTING MACHINE

FIELD OF THE INVENTION

The present invention relates to a cutting machine for cutting a workpiece such as a semiconductor wafer or the like.

DESCRIPTION OF THE PRIOR ART

In the production process of a semiconductor device, for example, individual semiconductor chips are manufactured by forming a circuit such as IC or LSI in a large number of areas sectioned by dividing lines called "streets" formed in a lattice pattern on the front surface of a substantially disk-like semiconductor wafer, and dividing the semiconductor wafer into the areas having a circuit formed thereon along the dividing lines. A cutting machine is generally used as a dicing machine to divide the semiconductor wafer. This cutting machine comprises a chuck table for holding a workpiece and a cutting means having a cutting blade for cutting the workpiece held on the chuck table, and cuts the workpiece by moving the chuck table relative to the cutting means while the cutting blade is rotated.

The above cutting machine is disclosed by JP-A 2003-163178. The cutting machine disclosed by this publication is constituted by a gate-like support frame that is arranged in the moving path of the chuck table for holding the workpiece and allows the movement of the chuck table, an alignment means arranged on one side of the gate-like support frame and a cutting means arranged on the other side of the gate-like support frame.

Since in the above-described cutting machine, the cutting means and the alignment means are arranged on the sides opposite to each other, of the interposed gate-like support frame, the distance between the alignment means and the cutting means becomes long, thereby causing the following problem. That is, when the distance between the alignment means and the cutting means is long, there is a probability that a case where alignment information obtained by the alignment means is not reflected on the cutting means properly by a mechanical error, thereby making it impossible to cut the workpiece along a predetermined dividing line precisely. Further, since the cutting means cuts the workpiece while cutting water is supplied, the cutting water is scattered. Therefore, the cutting means is located at a position secluded from an operation panel where an operator is located whereas the alignment means is located at a position close to the operation panel. Therefore, the operator must adjust the alignment means or exchange the cutting blade of the cutting means, from a side where the operation panel is located. When the cutting means is installed at a long distance from the alignment means, it is difficult to exchange or adjust the cutting blade.

SUMMARY OF THE INVENTION

It is an object of the present invention to provide a cutting machine capable of improving operation efficiency by arranging an alignment means and a cutting means to be mounted on a gate-like support frame so as to be near to each other.

To attain the above object, according to the present invention, there is provided a cutting machine comprising guide rails extending in a predetermined direction, chuck tables, which are arranged such that they can move along the guide rails and which each have a holding surface for holding a workpiece, cutting feed mechanisms for moving the chuck tables along the guide rails, a gate-like support frame that is arranged straddling the guide rails and has an opening for allowing the movement of the chuck tables, alignment means mounted on one flank of the gate-like support frame such that they can move in a direction perpendicular to the guide rails, and cutting means for cut the workpiece held on the chuck tables, which are mounted on the other flank of the gate-like support frame such that they can move in a direction perpendicular to the guide rails, wherein the cutting means are each composed of an indexing-feed base arranged on the other flank of the gate-like support frame such that it can move in a direction perpendicular to the guide rails, a cutting-in feed base arranged on the indexing-feed base such that it can move in a direction perpendicular to the holding surface of the chuck table, and a spindle unit that is mounted on the cutting-in feed base and has a cutting blade, the spindle unit being arranged on the alignment means side through the opening of the gate-like support frame.

Preferably, the above cutting-in feed base has a mounting portion that projects toward the alignment means side from the other flank side of the gate-like support frame through the opening, and the spindle unit is mounted on the mounting portion.

The above guide rail comprises a first guide rail and a second guide rail, which are arranged in parallel to each other, and the above chuck table consists of a first chuck table and a second chuck table, which can move along the first guide rail and the second guide rail, respectively.

The above cutting means consists of a first cutting means and a second cutting means, and the cutting blade of the first cutting means and the cutting blade of the second cutting means are opposed to each other.

The above alignment means consists of a first alignment means for picking up an image of a workpiece held on the first chuck table to detect the area to be cut and a second alignment means for picking up an image of a workpiece held on the second chuck table to detect the area to be cut.

Preferably, the above gate-like support frame is composed of a first pillar portion and a second pillar portion, which are arranged on both sides of the guide rails, and a support portion connecting both upper ends of the first and second pillar portions, the alignment means and the cutting means are mounted onto the support portion, and an opening for allowing the movement of the spindle unit of the cutting means is provided in the first pillar portion and the second pillar portion.

Further, it is desirable that the operation position of an operator is formed in front of the alignment means, and an operation panel is arranged facing the operator.

Since in the cutting machine according to the present invention, the spindle unit is mounted on the cutting-in feed base provided on the other flank of the gate-like support frame, on the alignment means side through the opening, the alignment means and the cutting means are located at positions close to each other, whereby alignment information is reflected on the cutting means without causing a mechanical error. Further, since the alignment means and the cutting blades are located at positions close to each other, they are at a close distance from the operator who is located on the operation side of the machine housing, thereby making it easy to exchange the cutting blades.

DETAILED DESCRIPTION OF THE PREFERRED EMBODIMENT

A preferred embodiment of the cutting machine constituted according to the present invention will be described in detail herein under with reference to the accompanying drawings.

Figure 1:
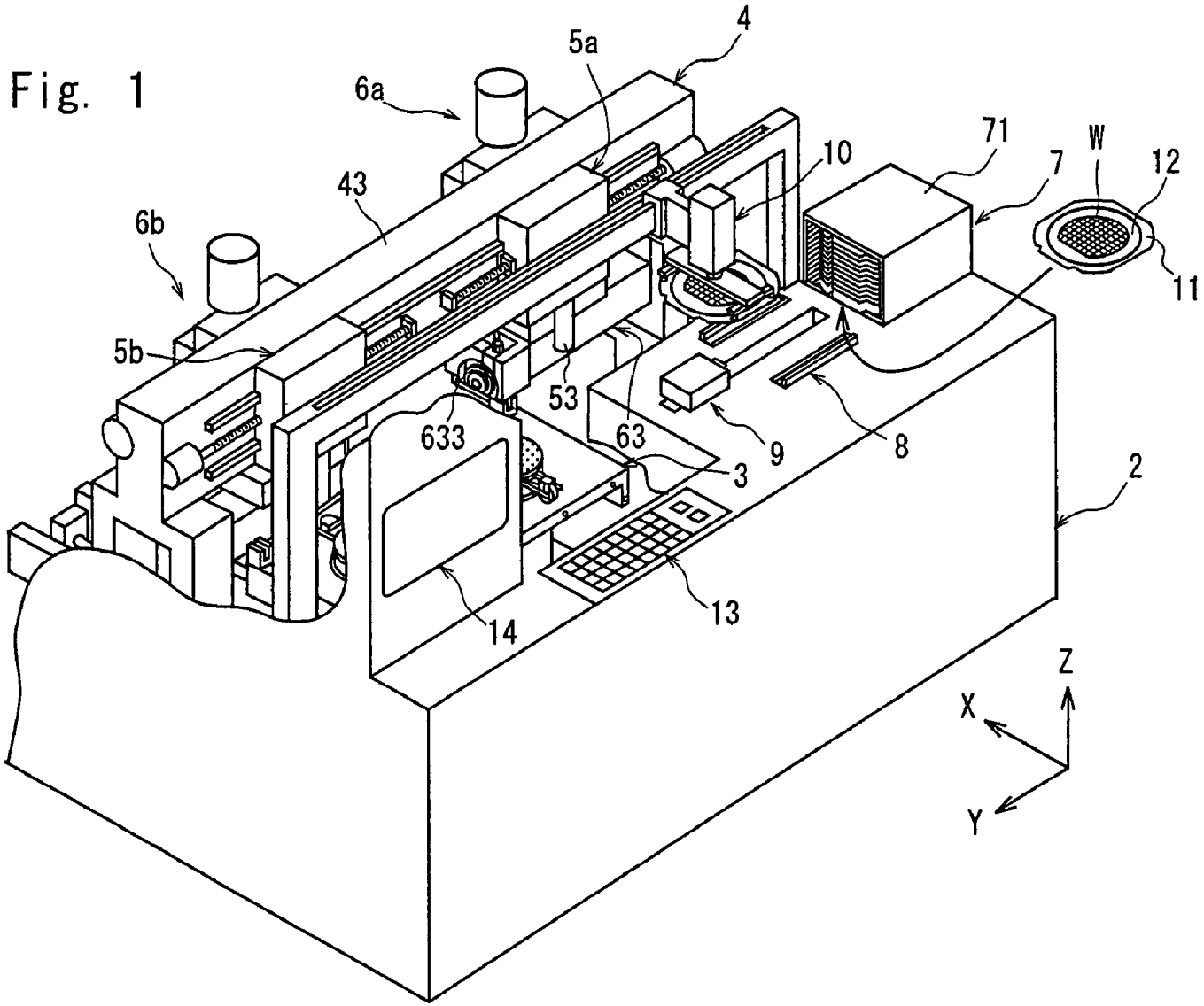
FIG. 1 is a perspective view, partly broken away, of a cutting machine constituted according to the present invention.

FIG. 1 is a perspective view, partly broken away, of a cutting machine constituted according to the present invention.

The cutting machine shown in FIG. 1 has a substantially rectangular parallelepiped housing 2. In this housing 2, there is arranged a chuck table mechanism 3 that holds a workpiece such as semiconductor wafer and moves it in a cutting-feed direction indicated by an arrow X. This chuck table mechanism 3 will be described with reference to FIG. 2.

The above chuck table mechanism 3 in the illustrated embodiment comprises a first guide rail 31*a* and a second guide rail 31*b* on the top surface of a base 20 installed in the above housing 2. The first guide rail 31*a* and the second guide rail 31*b* each consist of a pair of rail members 311 and 311, which extend in parallel to each other in the cutting-feed direction indicated by the arrow X in FIG. 2. A first support base 32*a* and a second support base 32*b* are mounted on the first guide rail 31*a* and the second guide rail 31*b* in such a manner that they can move along the first guide rail 31*a* and the second guide rail 31*b*, respectively. That is, the first support base 32*a* and the second support base 32*b* each have to-be-guided grooves 321 and 321 and are so constituted as to be moved along the first guide rail 31*a* and the second guide rail 31*b* by fitting the to-be-guided grooves 321 and 321 to the pairs of rail members 311 and 311 constituting the first guide rail 31*a* and the second guide rail 31*b*, respectively.

A first cylindrical member 33*a* and a second cylindrical member 33*b* are mounted on the first support base 32*a* and the second support base 32*b*, and a first chuck table 34*a* and a second chuck table 34*b* are rotatably mounted on the upper ends of the first cylindrical member 33*a* and the second cylindrical member 33*b*, respectively. The first chuck table 34*a* and the second chuck table 34*b* are constituted by a suitable porous material such as porous ceramic and each are connected to a suction means that is not shown. Therefore, the workpieces placed on placing surfaces 341 and 341 are suction-held by selectively communicating the first chuck table 34*a* and the second chuck table 34*b* to a suction source by the suction means that is not shown. The first chuck table 34*a* and the second chuck table 34*b* are designed to be properly turned by pulse motors (not shown) installed in the first cylindrical member 33*a* and the second cylindrical member 33*b*, respectively. The upper end portions of the first cylindrical member 33*a* and the second cylindrical member 33*b* have holes which permit the first chuck table 34*a* and the second chuck table 34*b* to go through, and are provided with a first cover member 35*a* and a second cover member 35*b* for covering the first support base 32*a* and the second support base 32*b*, respectively. On the top surfaces of the first cover member 35*a* and the second cover member 35*b*, there are installed a first blade detection means 36*a* and a second blade detection means 36*b* for detecting the positions of cutting blades later described, respectively.

Figure 2:
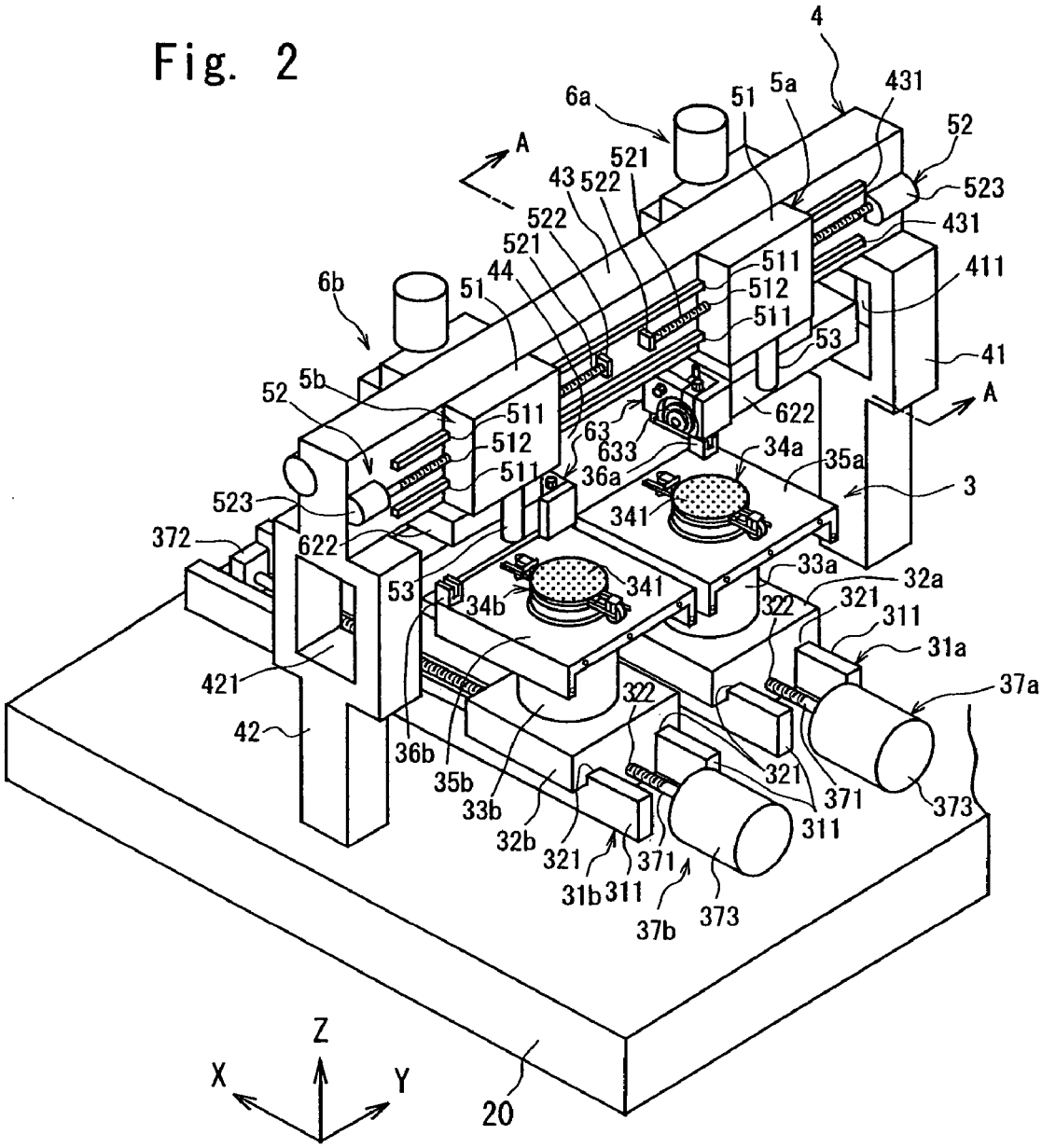
FIG. 2 is a perspective view of the principal section of the cutting machine shown in FIG. 1.

The chuck table mechanism 3 in the illustrated embodiment comprises a first cutting-feed means 37*a* and a second cutting-feed means 37*b* for moving the first chuck table 34*a* and the second chuck table 34*b* along the first guide rail 31*a* and the second guide rail 31*b* in the cutting-feed direction indicated by the arrow X in FIG. 2, respectively. The first cutting-feed means 37*a* and the second cutting-feed means 37*b* are each composed of a male screw rod 371 that is arranged between the pair of rail members 311 and 311 constituting the first guide rail 31*a* and the second guide rail 31*b* in parallel to them, a bearing 372 for rotatably supporting one end of the male screw rod 371, and a pulse motor 373 that is connected to the other end of the male screw rod 371 and drives the male screw rod 371 in a normal or reverse direction. The male screw rods 371 of the first cutting-feed means 37*a* and the second cutting-feed means 37*b* thus constituted are respectively screwed into female screws 322 formed in the first support base 32*a* and the second support base 32*b*. Accordingly, the first cutting-feed means 37*a* and the second cutting-feed means 37*b* can move the first chuck table 34*a* and the second chuck table 34*b* mounted on the first support base 32*a* and the second support base 32*b*, along the first guide rail 31*a* and the second guide rail 31*b* in the cutting-feed direction indicated by the arrow X in FIG. 2 by driving the pulse motors 373 to drive the male screw rods 371 in the normal or reverse direction, respectively.

Figure 4:
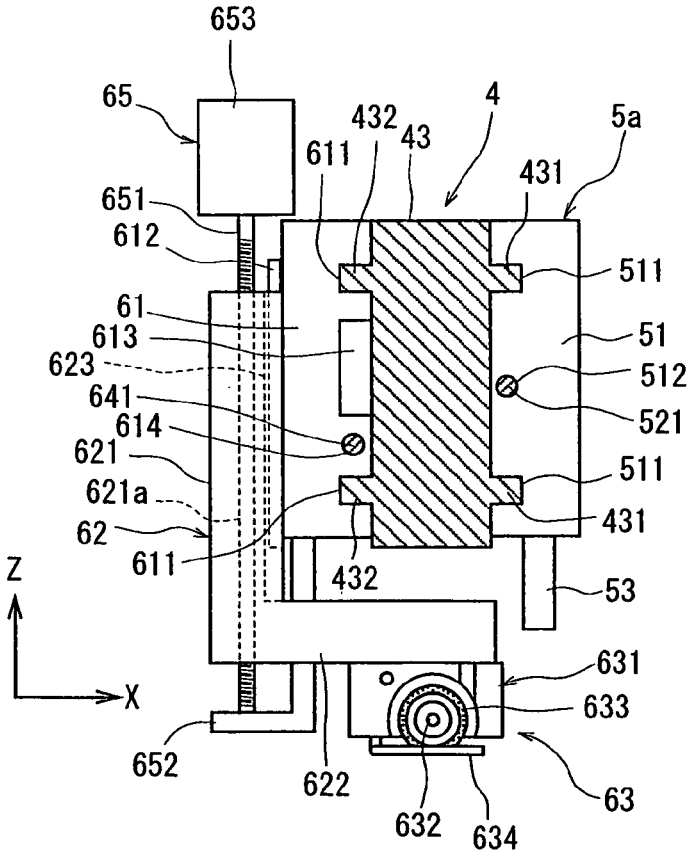
FIG. 4 is a sectional view cut on line A-A of FIG. 2.

Continuing a description with reference to FIG. 2, the cutting machine in the illustrated embodiment has a gate-like support frame 4 arranged straddling the first guide rail 31*a* and the second guide rail 31*b*. This gate-like support frame 4 comprises a first pillar portion 41 arranged on the side of the first guide rail 31*a*, a second pillar portion 42 arranged on the side of the second guide rail 31*b*, and a support portion 43 that connects the upper ends of the first pillar portion 41 and the second pillar portion 42 and is arranged in the indexing-feed direction indicated by the arrow Y perpendicular to the cutting-feed direction indicated by the arrow X, and an opening 44 for allowing the movements of the first chuck table 34*a* and the second chuck table 34*b* is formed in the center portion thereof. The upper end portions of the first pillar portion 41 and the second pillar portion 42 are made wide, and openings 411 and 421 for allowing the movements of the spindle units of a cutting means that will be described later are formed in the upper end portions thereof, respectively. A pair of guide rails 431 and 431 are provided on one flank of the above support portion 43 in the indexing-feed direction indicated by the arrow Y and a pair of guide rails 432 and 432 are provided on the other flank of the above support portion 43 in the indexing-feed direction indicated by the arrow Y, as shown in FIG. 4.

The cutting machine in the illustrated embodiment has a first alignment means 5*a* and a second alignment means 5*b*, which can move along the pair of guide rails 431 and 431 provided on the support portion 43 of the above gate-like support frame 4. The first alignment means 5*a* and the second alignment means 5*b* are each composed of a moving block 51, a moving means 52 for moving the moving block 51 along the pair of rails 431 and 431, and an image pick-up means 53 mounted on the moving block 51. The moving block 51 has to-be-guided grooves 511 and 511 to be fitted to the pair of guide rails 431 and 431 and is so constituted as to be moved along the pair of guide rails 431 and 431 by fitting the to-be-guided grooves 511 and 511 to the pair of guide rails 431 and 431.

The moving means 52 and 52 are each composed of a male screw rod 521 that is arranged between the pair of guide rails 431 and 431 in parallel to them, a bearing 522 for rotatably supporting one end of the male screw rod 521, and a pulse motor 523 that is connected to the other end of the male screw rod 521 and drives the male screw rod 521 in the normal or reverse direction. The male screw rods 521 of the thus constituted moving means 52 and 52 are each screwed into female screws 512 formed in the above moving blocks 51. Accordingly, the moving means 52 and 52 can move the moving blocks 51 and 51 along the pair of guide rails 431 and 431 in the indexing-feed direction indicated by the arrow Y in FIG. 2 by driving the pulse motor 523 to drive the male screw rods 521 in the normal or reverse direction.

The image pick-up means 53 and 53 mounted on the above respective moving blocks 51 and 51 have each an image pick-up device (CCD), and transmit a picked up image signal to a control means that is not shown.

A first cutting means 6*a* and a second cutting means 6*b* are mounted on the other flank (i.e., flank opposite to the flank on which the first alignment means 5*a* and the second alignment means 5*b* are mounted) of the support portion 43 constituting the above gate-like support frame 4. The first cutting means 6*a* and the second cutting means 6*b* will be described with reference to FIG. 3 and FIG. 4. The first cutting means 6*a* and the second cutting means 6*b* are each composed of an indexing-feed base 61, a cutting-in feed base 62, and a spindle unit 63. The indexing-feed base 61 has, on one flank, to-be-guided grooves 611 and 611 to be fitted to the pair of guide rails 432 and 432 provided on the other flank of the support portion 43 and is so constituted as to be moved along the pair of guide rails 432 and 432 by fitting the to-be-guided grooves 611 and 611 to the pair of guide rails 432 and 432. A pair of guide rails 612 and 612 (only one guide rail is shown in FIG. 4) are provided on the other flank of the indexing-feed base 61 in the cutting-in direction (direction perpendicular to the placing surfaces 341 of the first chuck table 34*a* and the second chuck table 34*b*) indicated by the arrow Z as shown in FIG. 4. Clearance grooves 613 and 613 for allowing the insertion of the male screw rods of an indexing-feed means that will be described later are formed in the one flank of the indexing-feed bases 61 and 61 with a difference in level in the vertical direction, respectively.

The above cutting-in feed bases 62 are each composed of a to-be-supported portion 621 extending in the vertical direction and a mounting portion 622 extending horizontally at a right angle from the lower end of the to-be-supported portion 621. As shown in FIG. 4, to-be-guided grooves 623 and 623 (only one to-be-guided groove is shown in FIG. 4) to be fitted to the pair of guide rails 612 and 612 provided on the other flank of the indexing-feed base 61 are formed in the mounting portion 622 side surface of the to-be-supported portion 621. By fitting the to-be-guided grooves 623 and 623 to the pair of guide rails 612 and 612, the cutting-in feed base 62 is so constituted as to be moved along the pair of guide rails 612 and 612 in the cutting-in feed direction indicated by the arrow Z. The mounting portion 622 of the cutting-in feed base 62 mounted on the indexing-feed base 61 is arranged projecting toward one side where the above first alignment means 5*a* and second alignment means 5*b* are mounted, from the other side where the indexing-feed base 61 is mounted, of the gate-like support frame 4 through the opening 44, as shown in FIG. 2.

Figure 3:
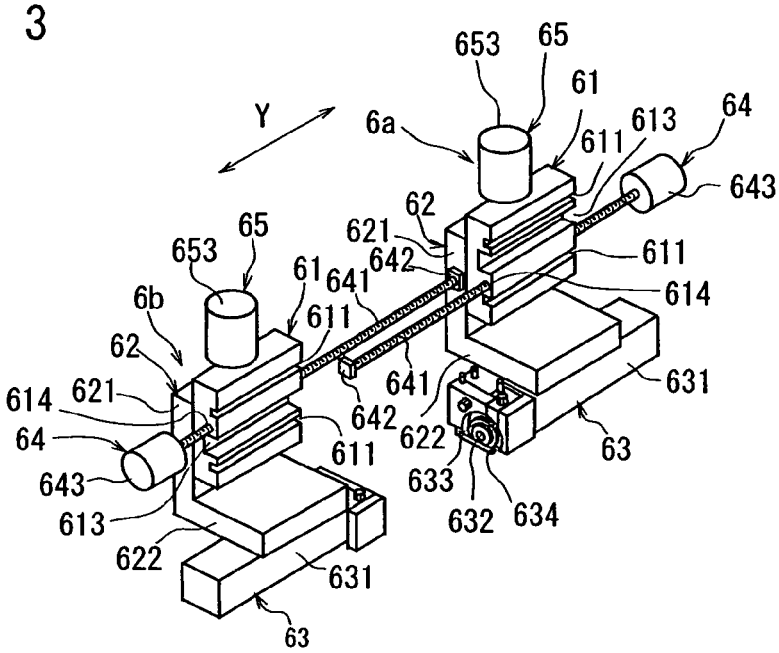
FIG. 3 is a perspective view showing the cutting means of the cutting machine shown in FIG. 1.

The above spindle units 63 are each mounted on the undersurface of the mounting portions 622 forming the cutting-in feed bases 62 of the first cutting means 6*a* and the second cutting means 6*b*. The spindle units 63 are each composed of a spindle housing 631, a rotary spindle 632 rotatably supported in the spindle housing 631, a cutting blade 633 mounted onto one end of the rotary spindle 632, a cutting water supply pipe 634 for supplying cutting water, and a servo motor (not shown) for rotary-driving the rotary spindle 632, as shown in FIG. 3, and the axis of the rotary spindle 632 is arranged along the indexing-feed direction indicated by the arrow Y. Accordingly, the spindle units 63 thus mounted on the mounting portions 622 forming the cutting-in feed bases 62 are located near the first alignment means 5*a* and the second alignment means 5*b*. The cutting blade 633 of the first cutting means 6*a* and the cutting blade 633 of the second cutting means 6*b* are opposed to each other.

The first cutting means 6*a* and the second cutting means 6*b* in the illustrated embodiment comprise indexing-feed means 64 and 64 for moving the above indexing-feed bases 61 and 61 along the pair of guide rails 432 and 432 in the indexing-feed direction indicated by the arrow Y, as shown in FIG. 3. The indexing-feed means 64 and 64 are each composed of a male screw rod 641 that is arranged between the pair of guide rails 432 and 432 in parallel to them, a bearing 642 for rotatably supporting one end of the male screw rod 641, and a pulse motor 643 that is connected to the other end of the male screw rod 641 and drives the male screw rod 641 in the normal or reverse direction. The male screw rods 641 and 641 are arranged at heights corresponding to the clearance grooves 613 and 613 provided in the indexing-feed bases 61 and 61. The male screw rods 641 and 641 of the thus constituted indexing-feed means 64 and 64 are screwed into female screws 614 and 614 formed in the indexing-feed bases 61 and 61, respectively. Therefore, the indexing-feed means 64 and 64 can move the indexing-feed bases 61 and 61 along the pair of guide rails 432 and 432 in the indexing-feed direction indicated by the arrow Y in FIG. 2 by driving the pulse motors 643 and 643 to drive the male screw rods 641 and 641 in the normal or reverse direction, respectively. The movements of the indexing-feed bases 61 and 61 are allowed by the insertion of the male screw rods 641 and 641 into the clearance grooves 613 and 613 provided in the indexing-feed bases 61 and 61.

The first cutting means 6*a* and the second cutting means 6*b* in the illustrated embodiment comprise cutting-in feed means 65 and 65 for moving the cutting-in feed bases 62 and 62 along the pair of guide rails 612 and 612 in the cutting-in feed direction indicated by the arrow Z, as shown in FIG. 3 and FIG. 4, respectively. The cutting-in feed means 65 and 65 are each composed of a male screw rod 651 that is arranged between the pair of guide rails 612 and 612 in parallel to them, a bearing 652 for rotatably supporting one end of the male screw rod 651, and a pulse motor 653 that is connected to the other end of the male screw rod 651 and drives the male screw rod 651 in the normal or reverse direction. The male screw rods 651 and 651 of the thus constituted cutting-in feed means 65 and 65 are screwed into female screws 621*a* formed in the supported portions 621 of the cutting-in feed bases 62. Therefore, the cutting-in feed means 65 and 65 can move the cutting-in feed bases 62 along the pairs of guide rails 612 and 612 in the cutting-in feed direction indicated by the arrow Z in FIG. 2 by driving the pulse motors 653 to drive the male screw rods 651 and 651 in the normal or reverse direction, respectively.

Returning to FIG. 1, the description will be continued further. In the above housing 2, there are installed a cassette mechanism 7 for storing workpieces such as semiconductor wafers, a workpiece carry-in/carry-out means 9 for carrying out a workpiece stored in the cassette mechanism 7 to a temporary storage area 8 and carrying the workpiece after cutting in the cassette mechanism 7, and a workpiece conveying means 10 for carrying the workpiece between the temporary storage area 8 and the first chuck table 34*a* or between the temporary storage area 8 and the second chuck table 34*b*. In the cassette mechanism 7, a cassette 71 is placed on the cassette table of a lift means that is not shown. A semiconductor wafer W that is put on the surface of a protective tape 12 affixed to an annular frame 11 is stored in the cassette 71. An operation panel 13 and a display means 14 for displaying images picked up by the above image pick-up means 53 and 53 are installed on the housing 2. In the cutting machine in the illustrated embodiment, the operation position of the operator is located in front of the above first alignment means 5*a* and the second alignment means 5*b*, and the operation panel 13 is disposed at a position opposed to the operator.

The cutting machine in the illustrated embodiment is constituted as described above, and its operation will be described with reference to FIG. 1 and FIG. 2.

The lift means (not shown) of the cassette mechanism 7 is first activated to bring the cassette 71 to a position that is a suitable height. After the cassette 7 is positioned at the suitable height, the workpiece carry-in/carry-out mechanism 9 is activated to carry a semiconductor wafer W stored in the cassette 71 to the temporary storage area 8. The semiconductor wafer W carried to the temporary storage area 8 is centered herein. The semiconductor wafer W centered in the temporary storage area 8 is carried onto the top surface of the first chuck table 34*a* by the workpiece conveying means 10. At this point, the first chuck table 34*a* is positioned at a workpiece placing/displacing position shown in FIG. 2. The semiconductor wafer W placed on the first chuck table 34*a* is suction-held on the first chuck table 34*a* by activating the suction means that is not shown.

The first chuck table 34*a* suction-holding the semiconductor wafer W as described above is moved to an alignment area that is at a position below the first alignment means 5*a* by activating the first cutting-feed means 37*a*. Thereafter, the image pick-up means 53 of the first alignment means 5*a* is positioned right above the first chuck table 34*a* by activating the moving means 52 of the first alignment means 5*a*. After the image pick-up means 53 is positioned right above the first chuck table 34*a*, an image of the surface of the semiconductor wafer W held on the first chuck table 34*a* is picked up by the image pick-up means 53 to detect one street (dividing line) which is the area to be cut, formed on the front surface of the semiconductor wafer W. The alignment of the street detected by the above image pick-up means 53 with the cutting blade 633 is carried out by activating the indexing-feed means 64 of the first cutting means 6*a*. At this point, as the first alignment means 5*a* and the cutting blade 633 of the first cutting means 6*a* are arranged at positions close to each other in the illustrated embodiment, alignment information is reflected on the first cutting means 6*a* without causing a mechanical error.

The cutting blade 633 is then brought to a position corresponding to the predetermined street formed on the semiconductor wafer W held on the first chuck table 34*a* by activating the indexing-feed means 64 of the first cutting means 6*a*, and is lowered to a predetermined cutting-feed position by further activating the cutting-in feed means 65. Then, the first chuck table 34*a* is moved to a cutting area in the direction indicated by the arrow X, which is the cutting-feed direction, by activating the first cutting-feed means 37*a* while the cutting blade 633 is rotated, so that the cutting blade 633 rotating at a high speed works onto the semiconductor wafer W held on the first chuck table 34*a* to cut it along the predetermined street (cutting step). In this cutting step, cutting water is supplied to a cut portion from the cutting water supply pipe 634.

After the semiconductor wafer W held on the first chuck table 34*a* is cut along the predetermined street as described above, the indexing-feed means 64 is activated to move the first cutting means 6*a* by a distance corresponding to the interval between streets in the indexing-feed direction indicated by the arrow Y (indexing-feed step) to carry out the above cutting step consecutively. Thus, the indexing-feed step and the cutting step are carried out repeatedly to cut the semiconductor wafer W along all the streets formed in the predetermined direction. After the semiconductor wafer W is cut along all the streets formed in the predetermined direction, the first chuck table 34*a* holding the semiconductor wafer W is turned at 90°. The above indexing-feed step and the cutting step are then carried out repeatedly on the semiconductor wafer W held on the first chuck table 34*a*, whereby the semiconductor wafer W is cut along all the streets formed in a lattice pattern to divide it into individual chips. Even when the semiconductor wafer W is divided into individual chips, the individual chips do not fall apart and the form of the wafer is maintained as they are put on the protective tape 12 affixed to the annular frame 11.

Between the above indexing-feed step and the cutting step or after the indexing-feed step and the cutting step, the image pick-up means 53 of the first alignment means 5*a* is brought at a position right above a groove formed in the semiconductor wafer W held on the first chuck table 34*a* by activating the moving means 52 of the first alignment means Sa. An image of the groove is then picked up by the image pick-up means 53 and displayed on the display means 14, thereby making it possible to detect and check the cut state of the groove.

After the semiconductor wafer W held on the first chuck table 34*a* is divided along the streets, the first chuck table 34*a* is moved to the above workpiece placing/displacing position, and the suction-holding of the semiconductor wafer W is canceled. Thereafter, the semiconductor wafer W held on the first chuck table 34*a* is carried to the temporary storage area 8 by activating the workpiece conveying means 10. The semiconductor wafer W after cutting-processing carried to the temporary storage area 8 is stored in the cassette 71 by the workpiece carry-in/carry-out means 9.

While the alignment work, the indexing-feed step and the cutting step are carried out on the semiconductor wafer W held on the first chuck table 34*a* as described above, the workpiece carry-in/carry-out means 9 is activated to carry a semiconductor wafer W stored in the cassette 71 to the temporary storage area 8. A centering of the semiconductor wafer W carried to the temporary storage area 8 is done in this temporary storage area 8. The semiconductor wafer W centered in the temporary storage area 8 is carried onto the top surface of the second chuck table 34*b* located at the workpiece placing/displacing position by the workpiece conveying means 10. The semiconductor wafer W placed on the second chuck table 34*b* is suction-held on the second chuck table 34*b* by activating the suction means that is not shown.

After the semiconductor wafer W is suction-held on the second chuck table 34*b*, the aforementioned alignment work is carried out by the second alignment means 5*b*, and the above indexing-feed step and the cutting step are also carried out by the second cutting means 6*b*. Further, the aforementioned groove checking work is carried out by the second alignment means 5*b*. In the cutting machine in the illustrated embodiment, while the alignment work, the indexing-feed step, the cutting step and the groove checking work are carried out on the semiconductor wafer W held on the first chuck table 34*a*, the alignment work, the indexing-feed step, the cutting step and the groove checking work can be carried out on the semiconductor wafer W held on the second chuck table 34*b*, as described above, thereby making it possible to improve productivity.

The cutting blades 633 of the first cutting means 6*a* and the second cutting means 6*b* wear out by carrying out the above-described cutting step. Therefore, the wear-out states of the cutting blades 633 are detected by the above first blade detection means 36*a* and the second blade detection means 36*b*, and when the wear-out amount reaches a predetermined value, the cutting blade is exchanged for new one. On this occasion, since the spindle units 63 mounted on the mounting portions 622 forming the cutting-in feed bases 62 of the first cutting means 6*a* and the second cutting means 6*b* are arranged at positions close to the first alignment means 5*a* and the second alignment means 5*b*, the work of exchanging the cutting blades become easy because the spindle units 63 are at a short distance from the operator standing on the operation panel 13 side of the housing 2.

Further, the cutting work can be also carried out by the following procedure in the cutting machine in the illustrated embodiment.

A first alignment step for picking up an image of the workpiece held on the first chuck table 34*a* by means of the first alignment means 5*a* to detect the area to be cut is first carried out. Further, a second alignment step for picking up an image of the workpiece held on the second chuck table 34*b* by means of the second alignment means 5*b* to detect the area to be cut is also carried out. After the first alignment step is carried out, next comes the first cutting step for cutting the workpiece held on the first chuck table 34*a* by means of the first cutting means 6*a* and the second cutting means 6*b*. In the middle of this first cutting step or after the first cutting step, a first groove detection step for picking up an image of a groove formed in the workpiece held on the first chuck table 34*a* to detect the state of the groove is carried out by the first alignment means 5*a*. After the above second alignment step is carried out, next comes the second cutting step for cutting the workpiece held on the second chuck table 34*b* by means of the first cutting means 6*a* and the second cutting means 6*b*. In the middle of this second cutting step or after the second cutting step, a second groove detection step for picking up an image of a groove formed in the workpiece held on the second chuck table 34*b* to detect the state of the groove is carried out by the second alignment means 5*b*. It is desired that the above first groove detection step be carried out at the time of execution of the second alignment step and that the second groove detection step be carried out at the time of execution of the first alignment step.

By carrying out the cutting work by the above procedure, the step of aligning the workpiece and the step of detecting the state of the groove formed by cutting the workpiece can be carried out at the same time, and as there are installed two chuck tables in the cutting machine, the workpiece held on one chuck table can be cut during the work of placing the workpiece onto the other chuck table or displacing the workpiece from the other chuck table, thereby making it possible to cut the workpieces under full operation of the first cutting means and the second cutting means without taking into account times spent for the alignment work, the work of detecting the groove and the work of placing or displacing the workpiece.

What is claimed is:

1. A cutting machine comprising a guide rail extending in a predetermined direction, a chuck table, which is arranged such that it can move along the guide rail, and has a holding surface for holding a workpiece, a cutting feed mechanism for cutting-feeding the chuck table along the guide rail, a support frame that is arranged straddling the guide rail and has an opening for allowing the movement of the chuck table, an alignment means mounted on one lateral surface of the support frame such that it can move in a direction perpendicular to the guide rail, and a cutting means for cutting the workpiece held on the chuck table, which is mounted on another lateral surface of the support frame such that it can move in a direction perpendicular to the guide rail, wherein the cutting means is composed of an indexing-feed base arranged on the other lateral surface of the support frame such that it can move in a direction perpendicular to the guide rail, a cutting-in feed base arranged on the indexing-feed base such that it can move in a direction perpendicular to the holding surface of the chuck table, and a spindle unit that is mounted on the cutting-in feed base and has a cutting blade, the spindle unit being arranged on a side of the alignment means side through the opening of the support frame.

2. The cutting machine according to claim 1, wherein the cutting-in feed base has a mounting portion that projects toward the side of the alignment means from the other side of the support frame through the opening, and the spindle unit is mounted on the mounting portion.

3. The cutting machine according to claim 1, wherein the guide rail consists of a first guide rail and a second guide rail, which are arranged in parallel to each other, and the chuck table consists of a first chuck table and a second chuck table, which can move along the first guide rail and the second guide rail, respectively.

4. The cutting machine according to claim 3, wherein the cutting means consists of a first cutting means and a second cutting means, and the cutting blade of the first cutting means and the cutting blade of the second cutting means are opposed to each other.

5. The cutting machine according to claim 3, wherein the alignment means consists of a first alignment means for picking up an image of a workpiece held on the first chuck table to detect the area to be cut and a second alignment means for picking up an image of a workpiece held on the second chuck table to detect the area to be cut.

6. The cutting machine according to claim 1, wherein the support frame is composed of a first pillar portion and a second pillar portion, which are arranged on both sides of the guide rail and a support portion connecting both upper ends of the first and second pillar portions, the alignment means and the cutting means are mounted onto the support portion, and an opening for allowing the movement of the spindle unit of the cutting means is provided in the first pillar portion and the second pillar portion.

7. The cutting machine according to claim 1, wherein the operation position of an operator is formed in front of the alignment means, and an operation panel is arranged facing the operator.

* * * * *